US006328104B1

(12) United States Patent
Graue

(10) Patent No.: US 6,328,104 B1
(45) **Date of Patent: *Dec. 11, 2001**

(54) UPGRADING AND RECOVERY OF HEAVY CRUDE OILS AND NATURAL BITUMENS BY IN SITU HYDROVISBREAKING

(75) Inventor: Dennis J. Graue, Denver, CO (US)

(73) Assignee: World Energy Systems Incorporated, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/490,958

(22) Filed: Jan. 24, 2000

Related U.S. Application Data

(63) Continuation-in-part of application No. 09/103,770, filed on Jun. 24, 1998, now Pat. No. 6,016,867.

(51) Int. Cl.[7] ..... E21B 43/24
(52) U.S. Cl. ..... 166/259; 166/59; 166/261
(58) Field of Search ..... 166/59, 261, 267, 166/259, 302, 57, 256, 303

(56) References Cited

U.S. PATENT DOCUMENTS

| | | |
|---|---|---|
| 2,506,853 | 5/1950 | Berg et al. . |
| 2,584,606 | 2/1952 | Merriam et al. . |
| 2,734,578 | 2/1956 | Walter . |
| 2,857,002 | 10/1958 | Pevere et al. . |
| 2,887,160 | 5/1959 | De Priester et al. . |
| 3,051,235 | 8/1962 | Banks . |
| 3,084,919 | 4/1963 | Slater . |
| 3,102,588 | 9/1963 | Fisher . |
| 3,208,514 | 9/1965 | Dew et al. . |
| 3,228,467 | 1/1966 | Schlinger et al. . |
| 3,254,721 | 6/1966 | Smith . |
| 3,327,782 | 6/1967 | Hujsak . |
| 3,372,754 | 3/1968 | McDonald . |
| 3,456,721 | 7/1969 | Smith . |
| 3,595,316 | 7/1971 | Myrick, III . |
| 3,598,182 | 8/1971 | Justheim . |
| 3,617,471 | 11/1971 | Schlinger et al. . |

(List continued on next page.)

*Primary Examiner*—Frank Tsay
(74) *Attorney, Agent, or Firm*—Arthur F Zobal; Geoffrey A. Mantooth

(57) ABSTRACT

A process is disclosed for the in situ conversion and recovery of heavy crude oils and natural bitumens from subsurface formations using either a continuous operation with one or more vertical injection boreholes and one or more vertical production boreholes in which multiple, uncased, horizontal boreholes may extend from the vertical boreholes, or a cyclic operation whereby both injection and production occur in the same vertical boreholes in which multiple, uncased, horizontal boreholes may extend from the vertical boreholes. A mixture of reducing gases, oxidizing gases, and steam are fed to downhole combustion devices located in the injection boreholes. Combustion of the reducing gas-oxidizing gas mixture is carried out to produce superheated steam and hot reducing gases for injection into the formation to convert and upgrade the heavy crude or bitumen into lighter hydrocarbons. Communication between the injection and production boreholes in the continuous operation and fluid mobility within the formation in the cyclic operation is induced by fracturing, multiple horizontal boreholes extending from vertical boreholes, or other related methods. In the continuous mode, the injected steam and reducing gases drive upgraded hydrocarbons and virgin hydrocarbons to the production boreholes for recovery. In the cyclic operation, wellhead pressure is reduced after a period of injection causing injected fluids, upgraded hydrocarbons, and virgin hydrocarbons in the vicinity of the boreholes to be produced. Injection and production are then repeated for additional cycles. In both operations, the hydrocarbons produced are collected at the surface for further processing.

2 Claims, 7 Drawing Sheets

U.S. PATENT DOCUMENTS

| | | | | |
|---|---|---|---|---|
| 3,700,035 | * | 10/1972 | Lange | 166/261 |
| 3,707,189 | | 12/1972 | Prats . | |
| 3,908,762 | | 9/1975 | Redford . | |
| 3,982,591 | | 9/1976 | Hamrick et al. . | |
| 3,982,592 | | 9/1976 | Hamrick et al. . | |
| 3,986,556 | | 10/1976 | Haynes . | |
| 3,990,513 | | 11/1976 | Perch . | |
| 3,994,340 | | 11/1976 | Anderson et al. . | |
| 4,024,912 | | 5/1977 | Hamrick et al. . | |
| 4,037,658 | | 7/1977 | Anderson . | |
| 4,050,515 | | 9/1977 | Hamrick et al. . | |
| 4,053,015 | | 10/1977 | Hamrick et al. . | |
| 4,077,469 | | 3/1978 | Hamrick et al. . | |
| 4,078,613 | | 3/1978 | Hamrick et al. . | |
| 4,099,568 | | 7/1978 | Allen . | |
| 4,127,171 | | 11/1978 | Allen . | |
| 4,141,417 | | 2/1979 | Schora et al. . | |
| 4,148,358 | | 4/1979 | Compton . | |
| 4,159,743 | | 7/1979 | Rose et al. . | |
| 4,160,479 | | 7/1979 | Richardson et al. . | |
| 4,183,405 | | 1/1980 | Magnie . | |
| 4,186,800 | | 2/1980 | Allen . | |
| 4,199,024 | | 4/1980 | Rose et al. . | |
| 4,233,166 | | 11/1980 | Allen . | |
| 4,241,790 | | 12/1980 | Magnie . | |
| 4,265,310 | | 5/1981 | Britton et al. . | |
| 4,284,139 | | 8/1981 | Sweany . | |
| 4,324,291 | | 4/1982 | Wong et al. . | |
| 4,444,257 | | 4/1984 | Stine . | |
| 4,448,251 | * | 5/1984 | Stine | 166/261 X |
| 4,476,927 | | 10/1984 | Riggs . | |
| 4,487,264 | | 12/1984 | Hyne et al. . | |
| 4,501,445 | | 2/1985 | Gregoli . | |
| 4,597,441 | | 7/1986 | Ware et al. . | |
| 4,691,771 | | 9/1987 | Ware et al. . | |
| 4,865,130 | | 9/1989 | Ware et al. . | |
| 5,054,551 | | 10/1991 | Duerksen . | |
| 5,055,030 | * | 10/1991 | Schirmer | 166/59 X |
| 5,105,887 | | 4/1992 | Hewgill et al. . | |
| 5,145,003 | | 9/1992 | Kuerksen . | |
| 5,163,511 | | 11/1992 | Amundson et al. . | |

* cited by examiner

UPGRADING AND RECOVERY OF HEAVY CRUDE OILS AND NATURAL BITUMENS BY IN SITU HYDROVISBREAKING

This application is a continuation-in-part of U.S. application Ser. No. 09/103,770, filed Jun. 24, 1998, now U.S. Pat. No. 6,016,867.

BACKGROUND OF THE INVENTION

1. Field of the Invention

This invention relates to a process for simultaneously upgrading and recovering heavy crude oils and natural bitumens from subsurface reservoirs.

2. Description of the Prior Art

Worldwide deposits of natural bitumens (also referred to as "tar sands") and heavy crude oils are estimated to total more than five times the amount of remaining recoverable reserves of conventional crude [References 1,5]. But these resources (herein collectively called "heavy hydrocarbons") frequently cannot be recovered economically with current technology, due principally to the high viscosities which they exhibit in the porous subsurface formations where they are deposited. Since the rate at which a fluid flows in a porous medium is inversely proportional to the fluid's viscosity, very viscous hydrocarbons lack the mobility required for economic production rates.

Steam injection has been used for over 30 years to produce heavy oil reservoirs economically by exploiting the strong negative relationship between viscosity and temperature that all liquid hydrocarbons exhibit. This relationship is illustrated in the drawing labeled FIG. 6, which includes plots 601, 603, 605, and 607 of viscosity as a function of temperature for heavy hydrocarbons from, respectively, the Street Ranch, Saner Ranch, Athabasca, and Midway Sunset deposits [Reference 6].

In one method of steam-assisted production, steam is injected into a formation through a borehole so that a portion of the heavy oil in the formation is heated, thereby significantly reducing its viscosity and increasing its mobility. Steam injection is then halted and the oil is produced through the same borehole. In a second method, after the oil-bearing formation is preheated sufficiently by steam injection into all boreholes, steam is continuously injected into the formation through a set of injection boreholes to drive oil to a set of production boreholes.

Referring again to FIG. 6, the plots show that heating the heavy hydrocarbons from say 100° F., a typical temperature for the subsurface deposits in which the hydrocarbons are found, to 400° F., a temperature that could be achieved in a subsurface deposit by injecting steam from the surface, reduces the viscosity of each of the four hydrocarbons by three to four orders of magnitude. Such viscosity reductions will not, however, necessarily result in economic production. The viscosity of Midway Sunset oil at 400° F. approaches that of a conventional crude, which makes it economic to produce. But even at 400° F., the viscosities of the bitumens from Athabasca, Street Ranch, and Saner Ranch are 50 to 100 times greater than the levels required to ensure economic rates of recovery. Moreover, the high viscosities of many heavy hydrocarbons, when coupled with commonly encountered levels of formation permeability, make the injection of steam or other fluids which might be used for heating a hydrocarbon-bearing formation difficult or nearly impossible.

In addition to high viscosity, heavy hydrocarbons often exhibit other deleterious properties which cause their refining into marketable products to be a significant challenge. These properties are compared in Table 1 for an internationally-traded light crude, Arabian Light, and three heavy hydrocarbons.

TABLE 1

Properties of Heavy Hydrocarbons Compared to a Light Crude

| | Light Crude | Heavy Hydrocarbons | | |
|---|---|---|---|---|
| Properties | Arabian Light | Orinoco | Cold Lake | San Miguel |
| Gravity, ° API | 34.5 | 8.2 | 11.4 | −2 to 0 |
| Viscosity, cp @ 100° F. | 10.5 | 7,000 | 10,700 | >1,000,000 |
| Sulfur, wt % | 1.7 | 3.8 | 4.3 | 7.9 to 9.0 |
| Nitrogen, wt % | 0.09 | 0.64 | 0.45 | 0.36 to 0.40 |
| Metals, wppm | 25 | 559 | 260 | 109 |
| Bottoms (975° F.+), vol % | 15 | 59.5 | 51 | 71.5 |
| Conradson carbon residue, wt % | 4 | 16 | 13.1 | 24.5 |

The high levels of undesirable components found in the heavy hydrocarbons shown in Table 1, including sulfur, nitrogen, metals, and Conradson carbon residue, coupled with a very high bottoms yield, require costly refining processing to convert the heavy hydrocarbons into product streams suitable for the production of transportation fuels.

Two fundamental alternatives exist for the upgrading of heavy hydrocarbon fractions: carbon rejection and hydrogen addition.

Carbon-rejection schemes break apart (or "crack") carbon bonds in a heavy hydrocarbon fraction and isolate the resulting asphaltenes from the lighter fractions. As the asphaltenes have significantly higher carbon-to-hydrogen ratios and higher concentrations of contaminants than the original feed, the product stream has a lower carbon-to-hydrogen ratio and significantly less contamination than the feed. Although less expensive than hydrogen-addition processes, carbon rejection has major disadvantages—significant coke production and low yields of liquid products which are of inferior quality.

Hydrogen-addition schemes convert unsaturated hydrocarbons to saturated products and high-molecular-weight hydrocarbons to hydrocarbons with lower molecular weights while removing contaminants without creating low-value coke. Hydrogen addition thereby provides a greater volume of total product than carbon rejection. The liquid product yield from hydrogen-addition processes can be 20 to 25 volume percent greater than the yield from processes employing carbon rejection. But these processes are expensive to apply and employ severe operating conditions. Catalytic hydrogenation, with reactor residence times of one to two hours, operate at temperatures in the 700 to 850° F. range with hydrogen partial pressures of 1,000 to 3,000 psi.

Converting heavy crude oils and natural bitumens to upgraded liquid hydrocarbons while still in a subsurface formation, which is the object of the present invention, would address the two principal shortcomings of these heavy hydrocarbon resources—the high viscosities which heavy hydrocarbons exhibit even at elevated temperatures and the deleterious properties which make it necessary to subject them to costly, extensive upgrading operations after they have been produced. However, the process conditions employed in refinery units to upgrade the quality of liquid hydrocarbons would be extremely difficult to achieve in the subsurface. The injection of catalysts would be exceptionally expensive, the high temperatures used would cause unwanted coking in the absence of precise control of hydrogen partial pressures and reaction residence time, and the hydrogen partial pressures required could cause random, unintentional fracturing of the formation with a potential loss of control over the process.

A process occasionally used in the recovery of heavy crude oil and natural bitumen which to some degree converts in the subsurface heavy hydrocarbons to lighter hydrocarbons is in situ combustion. In this process an oxidizing fluid, usually air, is injected into the hydrocarbon-bearing formation at a sufficient temperature to initiate combustion of the hydrocarbon. The heat generated by the combustion warms other portions of the heavy hydrocarbon and converts a part of it to lighter hydrocarbons via uncatalyzed thermal cracking, which may induce sufficient mobility in the hydrocarbon to allow practical rates of recovery.

While in situ combustion is a relatively inexpensive process, it has major drawbacks. The high temperatures in the presence of oxygen which are encountered when the process is applied cause coke formation and the production of olefins and oxygenated compounds such as phenols and ketones, which in turn cause major problems when the produced liquids are processed in refinery units. Commonly, the processing of products from thermal cracking is restricted to delayed or fluid coking because the hydrocarbon is degraded to a degree that precludes processing by other methods.

The present invention concerns an in situ process which converts heavy hydrocarbons to lighter hydrocarbons that does not involve in situ combustion or the short reaction residence times, high temperatures, high hydrogen partial pressures, and catalysts which are employed when conversion reactions are conducted in refineries. Rather, conditions which can readily be achieved in hydrocarbon-bearing formations are utilized; viz., reaction residence times on the order of days to months, lower temperatures, lower hydrogen partial pressures, and the absence of injected catalysts. These conditions sustain what we designate as "in situ hydrovisbreaking," conversion reactions within the formation which result in hydrocarbon upgrading similar to that achieved in refinery units through catalytic hydrogenation and hydrocracking. The present invention utilizes a unique combination of operations and associated hardware, including the use of a downhole combustion apparatus, to achieve hydrovisbreaking in formations in which high-viscosity hydrocarbons and commonly encountered levels of formation permeability combine to limit fluid mobility.

Following is a review of the prior art as related to the operations incorporated into this invention. The patents referenced teach or suggest a means for enhancing flow of heavy hydrocarbons within a reservoir, the use of a downhole apparatus for in situ operations, procedures for effecting in situ conversion of heavy crudes and bitumens, and methods for recovering and processing the produced hydrocarbons.

In U.S. Pat. No. 4,265,310, CONOCO patented the application of formation fracturing to steam recovery of heavy hydrocarbons.

Some of the best prior art disclosing the use of downhole devices for secondary recovery is found in U.S. Pat. Nos. 4,159,743; 5,163,511; 4,865,130; 4,691,771; 4,199,024; 4,597,441; 3,982,591; 3,982,592; 4,024,912; 4,053,015; 4,050,515; 4,077,469; and 4,078,613. Other expired patents which also disclose downhole generators for producing hot gases or steam are U.S. Pat. Nos. 2,506,853; 2,584,606; 3,372,754; 3,456,721; 3,254,721; 2,887,160; 2,734,578; and 3,595,316.

The concept of separating produced secondary crude oil into hydrogen, lighter oils, etc. and the use of hydrogen for in situ combustion and downhole steaming operations to recover hydrocarbons are found in U.S. Pat. Nos. 3,707,189; 3,908,762; 3,986,556; 3,990,513; 4,448,251; 4,476,927; 3,051,235; 3,084,919; 3,208,514; 3,327,782; 2,857,002; 4,444,257; 4,597,441; 4,241,790; 4,127,171; 3,102,588; 4,324,291; 4,099,568; 4,501,445; 3,598,182; 4,148,358; 4,186,800; 4,233,166; 4,284,139; 4,160,479; and 3,228,467. Additionally, in situ hydrogenation with hydrogen or a reducing gas is taught in U.S. Pat. Nos. 5,145,003; 5,105,887; 5,054,551; 4,487,264; 4,284;139; 4,183,405; 4,160,479; 4,141,417; 3,617,471; and 3,228,467.

U.S. Pat. No. 3,598,182 to Justheim; U.S. Pat. No. 3,327,782 to Hujsak; U.S. Pat. No. 4,448,251 to Stine; U.S. Pat. No. 4,501,445 to Gregoli; and U.S. Pat. No. 4,597,441 to Ware all teach variations of in situ hydrogenation which more closely resemble the current invention:

Justheim, U.S. Pat. No. 3,327,782 modulates (heats or cools) hydrogen at the surface. In order to initiate the desired objectives of "distilling and hydrogenation" of the in situ hydrocarbon, hydrogen is heated on the surface for injection into the hydrocarbon-bearing formation.

Hujsak, U.S. Pat. No. 4,448,251 teaches that hydrogen is obtained from a variety of sources and includes the heavy oil fractions from the produced oil which can be used as reformer fuel. Hujsak also includes and teaches the use of forward or reverse in situ combustion as a necessary step to effect the objectives of the process. Furthermore, heating of the injected gas or fluid is accomplished on the surface, an inefficient means of heating compared to using a downhole combustion unit because of heat losses incurred during transportation of the heated fluids to and down the borehole.

Stine, U.S. Pat. No. 4,448,251 utilizes a unique process which incorporates two adjacent, non-communicating reservoirs in which the heat or thermal energy used to raise the formation temperature is obtained from the adjacent reservoir. Stine utilizes in situ combustion or other methods to initiate the oil recovery process. Once reaction is achieved, the desired source of heat is from the adjacent zone.

Gregoli, U.S. Pat. No. 4,501,445 teaches that a crude formation is subjected to fracturing to form "an underground space suitable as a pressure reactor," in situ hydrogenation, and conversion utilizing hydrogen and/or a hydrogen donor solvent, recovery of the converted and produced crude, separation at the surface into various fractions, and utilization of the heavy residual fraction to produce hydrogen for re-injection. Heating of the injected fluids is accomplished on the surface which, as discussed above, is an inefficient process.

Ware, U.S. Pat. No. 4,597,441 describes in situ "hydrogenation" (defined as the addition of hydrogen to the oil without cracking) and "hydrogenolysis" (defined as hydrogenation with simultaneous cracking). Ware teaches the use of a downhole combustor. Reference is made to previous patents relating to a gas generator of the type disclosed in U.S. Pat. Nos. 3,982,591; 3,982,592; or 4,199,024. Ware further teaches and claims injection from the combustor of superheated steam and hydrogen to cause hydrogenation of petroleum in the formation. Ware also stipulates that after injecting superheated steam and hydrogen, sufficient pressure is maintained "to retain the hydrogen in the heated formation zone in contact with the petroleum therein for 'soaking' purposes for a period of time." In some embodiments Ware includes combustion of petroleum products in the formation—a major disadvantage, as discussed earlier—to drive fluids from the injection to the production wells.

None of the patents referenced above teach the application of fracturing or related methods to the hydrocarbon-bearing formation for the purpose of enhancing fluid mobility. In contrast, the Gregoli and Ware patents both teach that injected fluids must be confined with the in situ hydrocarbons to allow time for conversion reactions to take place. Further, none of the patents referenced include in situ conversion exclusively without combustion of the hydrocarbon in the formation.

Another group of U.S. Patents—including U.S. Pat. Nos. 5,145,003 and 5,054,551 to Duerksen; U.S. Pat. No. 4,160,479 to Richardson; U.S. Pat. No. 4,284,139 to Sweany; U.S. Pat. No. 4,487,264 to Hyne; and U.S. Pat. No. 4,141,417 to Schora—all teach variations of hydrogenation with heating of the injected fluids (hydrogen, reducing gas, steam, etc.) accomplished at the surface. Further, Schora, U.S. Pat. No. 4,141,417 injects hydrogen and carbon dioxide at a temperature of less than 300° F. and claims to reduce the hydrocarbon's viscosity and accomplish desulfurization. Viscosity reduction is assumed primarily through the well-known mechanism involving solution of carbon dioxide in the hydrocarbon. None of these patents includes the use of a downhole combustion unit for injection of hot reducing gases.

All of the U.S. patents mentioned are fully incorporated herein by reference thereto as if fully repeated verbatim immediately hereafter. In light of the current state of the technology, what is needed—and what has been discovered by us—is an efficient process for converting, and thereby upgrading, very heavy hydrocarbons in situ without combustion of the virgin hydrocarbon and the attendant degradation of products which accompany combustion operations. The process disclosed herein permits the production and utilization of heavy-hydrocarbon resources which are otherwise not economically recoverable by other methods and minimizes the amount of surface processing required to produce marketable petroleum products.

OBJECTIVES OF THE INVENTION

The primary objective of this invention is to provide a method for the in situ upgrading and recovery of heavy crude oils and natural bitumens. The process includes the heating of a targeted portion of a formation containing heavy crude or bitumen with steam and hot reducing gases to effect in situ conversion reactions—including hydrogenation, hydrocracking, desulfurization, and other reactions—referred to collectively as hydrovisbreaking. Fracturing of the subsurface formation or a related procedure is employed to enhance injection of the required fluids and increase the recovery rate of the upgraded hydrocarbons to an economic level.

It is another objective of this invention that no combustion of the virgin crude or bitumen occur in the formation so as to minimize in situ degradation of the converted hydrocarbons. In the instant invention, virgin hydrocarbons are only subjected to reducing conditions after being heated by steam injection and hot combustion gases. Formation hydrocarbons and converted products are therefore never subjected to the oxidation conditions encountered in conventional in situ combustion operations, thereby eliminating the product degradation which results from the formation of unstable oxygenated components.

An additional objective of this invention is the utilization of a downhole combustion unit to provide a thermally efficient process for the injection of superheated steam and hot reducing gases adjacent to the subsurface formation, thereby vastly reducing the heat losses inherent in conventional methods of subsurface injection of hot fluids.

A further objective of this invention is to eliminate much of the capital-intensive conversion and upgrading facilities, such as catalytic hydrocracking, that are required in conventional processing of heavy hydrocarbons by upgrading the hydrocarbons in situ.

SUMMARY OF THE INVENTION

This invention discloses a process for converting heavy crude oils and natural bitumens in situ to lighter hydrocarbons and recovering the converted materials for further processing on the surface. The conversion reactions—which may include hydrogenation, hydrocracking, desulfurization, and other reactions—are referred to herein as hydrovisbreaking. Continuous recovery utilizing one or more injection boreholes and one or more production boreholes, which may include multiple horizontal boreholes extended from vertical boreholes, may be employed. Alternatively, a cyclic method using one or more individual boreholes, which may include multiple horizontal boreholes extended from vertical boreholes, may be utilized.

The conditions necessary for sustaining the hydrovisbreaking reactions are achieved by injecting superheated steam and hot reducing gases, comprised principally of hydrogen, to heat the formation to a preferred temperature and to maintain a preferred level of hydrogen partial pressure. This is accomplished through the use of downhole combustion units, which are located in the injection boreholes at a level adjacent to the heavy hydrocarbon formation and in which hydrogen is combusted with an oxidizing fluid while partially saturated steam and, optionally, additional hydrogen are flowed from the surface to the downhole units to control the temperature of the injected gases.

The method of this invention also includes the creation of horizontal or vertical fractures to enhance the injectibility of the steam and reducing gases and the mobility of the hydrocarbons within the formation so that the produced fluids are recovered at economic rates. Alternatively, multiple horizontal boreholes extended from vertical boreholes, a zone of either high water saturation or high gas saturation in contact with the zone containing the heavy hydrocarbon, or a pathway between wells created by an essentially horizontal borehole may be utilized to enhance inter-well communication.

Prior to its production from the subsurface formation, the heavy hydrocarbon undergoes significant conversion and resultant upgrading in which the viscosity of the hydrocarbon is reduced by many orders of magnitude and in which its API gravity may be increased by 10 to 15 degrees or more.

Following is a summary of the process steps for a preferred embodiment to achieve the objectives of this invention:

a. inserting downhole combustion units within injection boreholes, which communicate with production boreholes by means of horizontal fractures or by multiple horizontal boreholes extended from the injection boreholes, at or near the level of the subsurface formation containing a heavy hydrocarbon;

b. for a first preheat period, flowing from the surface through said injection boreholes stoichiometric proportions of a reducing gas mixture and an oxidizing fluid to said downhole combustion units and igniting same in said downhole combustion units to produce hot combustion gases, including superheated steam, while flowing partially saturated steam from the surface through said injection boreholes to said downhole combustion units to control the temperature of said heated gases and to produce additional superheated steam;

c. injecting said superheated steam into the subsurface formation to heat a region of the subsurface formation to a preferred temperature;

d. for a second conversion period, increasing the ratio of reducing gas to oxidant in the mixture fed to the downhole combustion units, or injecting reducing gas in the fluid stream controlling the temperature of the combustion units, to provide an excess of reducing gas in the hot gases exiting the combustion units;

g. continuously injecting the heated excess reducing gas and superheated steam into the subsurface formation to provide preferred conditions and reactants to sustain in situ hydrovisbreaking and thereby upgrade the heavy hydrocarbon;

h. collecting continuously at the surface, from said production boreholes, production fluids comprised of converted liquid hydrocarbons, unconverted virgin heavy hydrocarbons, residual reducing gases, hydrocarbon gases, solids, water, hydrogen sulfide, and other components for further processing.

BRIEF DESCRIPTION OF THE DRAWINGS

FIG. 6 shows for the four cases the cumulative oil recovered as a percentage of the original oil in place (OOIP) as a function of production time.

DESCRIPTION OF THE PREFERRED EMBODIMENTS

Figure 1:
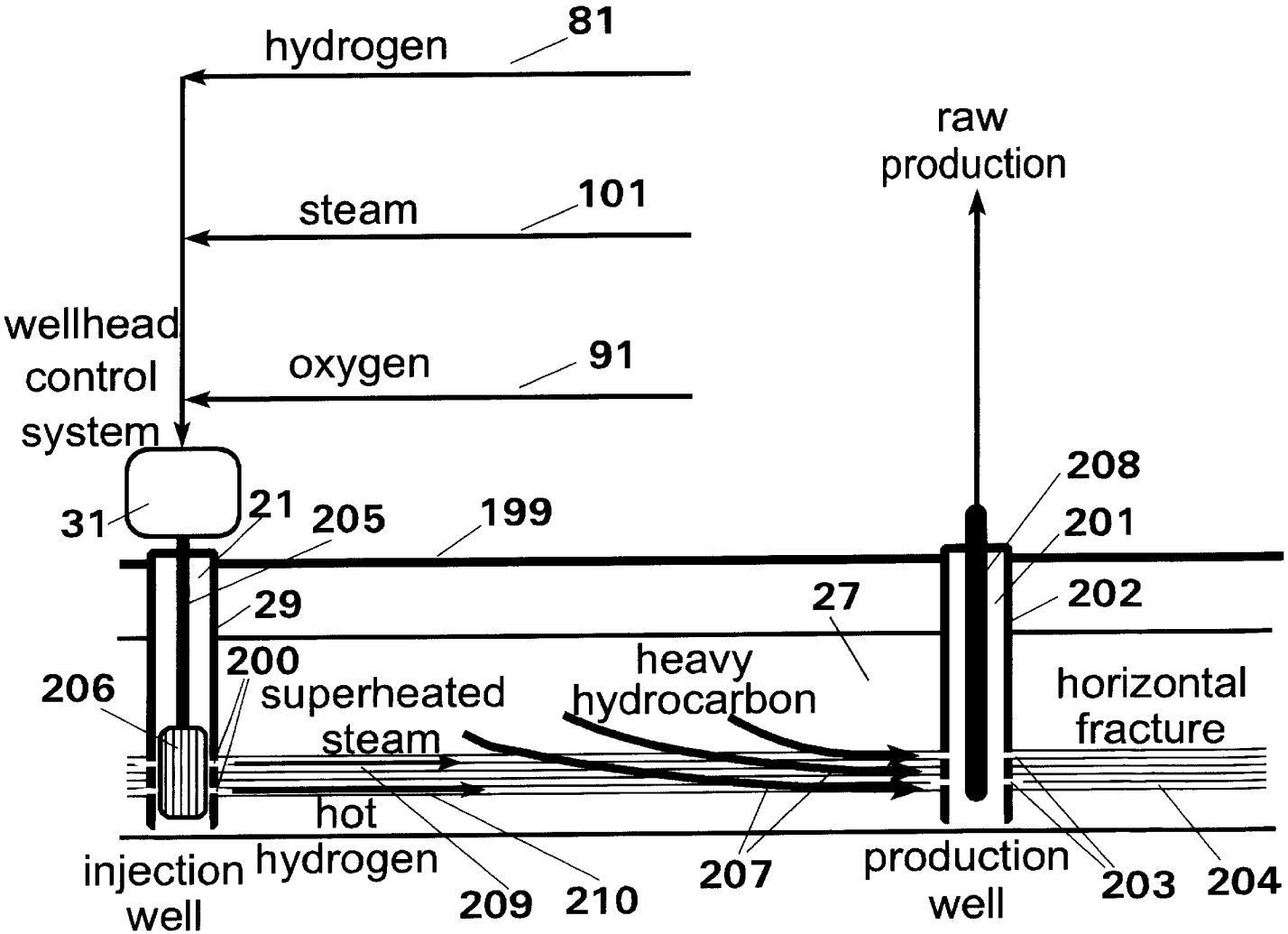
FIG. 1 is a schematic of a preferred embodiment of the invention in which injection boreholes and production boreholes are utilized in a continuous fashion. Steam and hot reducing gases from downhole combustion units in the injection boreholes are flowed toward the production boreholes where upgraded heavy hydrocarbons are collected and produced.

This invention discloses a process designed to upgrade and recover heavy hydrocarbons from subsurface formations which may not otherwise be economically recoverable while eliminating many of the deleterious and expensive features of the prior art. The invention incorporates multiple steps including: (a) use of downhole combustion units to provide a means for direct injection of superheated steam and hot reactants into the hydrocarbon-bearing formation; (b) enhancing injectibility and inter-well communication within the formation via formation fracturing or related methods; (c) in situ hydrovisbreaking of the heavy hydrocarbons in the formation by establishing suitable subsurface conditions via injection of superheated steam and reducing gases; (d) production of the upgraded hydrocarbons; (e) additional processing of the produced hydrocarbons on the surface to produce marketable products.

The process of in situ hydrovisbreaking as disclosed in this invention is designed to provide in situ upgrading of heavy hydrocarbons comparable to that achieved in surface units by modifying process conditions to those achievable within a reservoir—relatively moderate temperatures (625 to 750° F.) and hydrogen partial pressures (500 to 1,200 psi) combined with longer residence times (several days to months) in the presence of naturally occurring catalysts.

To effectively heat a heavy-hydrocarbon reservoir to the minimum desired temperature of 625° F. requires the temperature of the injected fluid be at least say 650° F., which for saturated steam corresponds to a saturation pressure of 2,200 psi. An injection pressure of this magnitude could cause a loss of control over the process as the parting pressure of heavy-hydrocarbon reservoirs, which are typically found at depths of about 1,500 ft, is generally less than 1,900 psi. Therefore, it is impractical to heat a heavy-hydrocarbon reservoir to the desired temperature using saturated steam alone. Use of conventionally generated superheated steam is also impractical because heat losses in surface piping and wellbores can cause steam-generation costs to be prohibitively high.

The limitation on using steam generated at the surface is overcome in this invention by use of a downhole combustion unit, which can provide heat to the subsurface formation in a more efficient manner. In its preferred operating mode, hydrogen is combusted with oxygen with the temperature of the combustion gases controlled by injecting partially saturated steam, generated at the surface, as a cooling medium. The superheated steam resulting from using partially saturated steam to absorb the heat of combustion in the combustion unit and the hot reducing gases exiting the combustion unit are then injected into the formation to provide the thermal energy and reactants required for the process.

Alternatively, a reducing-gas mixture—comprised principally of hydrogen with lesser amounts of carbon monoxide, carbon dioxide, and hydrocarbon gases—may be substituted for the hydrogen sent to the downhole combustion unit. A reducing-gas mixture has the benefit of requiring less purification yet still provides a means of sustaining the hydrovisbreaking reactions.

The downhole combustion unit is designed to operate in two modes. In the first mode, which is utilized for preheating the subsurface formation, the unit combusts stoichiometric amounts of reducing gas and oxidizing fluid so that the combustion products are principally superheated steam. Partially saturated steam injected from the surface as a coolant is also converted to superheated steam.

In a second operating mode, the amount of hydrogen or reducing gas is increased beyond its stoichiometric proportion (or the flow of oxidizing fluid is decreased) so that an excess of reducing gas is present in the combustion products. Alternatively, hydrogen or reducing gas is injected into the fluid stream controlling the temperature of the combustion unit. This operation results in the pressurizing of the heated subsurface region with hot reducing gas. Steam may also be injected in this operating mode to provide an injection mixture of steam and reducing gas.

The downhole combustion unit may be of any design which accomplishes the objectives stated above. Examples of the type of downhole units which may be employed include those described in U.S. Pat. Nos. 3,982,591; 4,050,515; 4,597,441; and 4,865,130.

The downhole combustion unit may be designed to operate in a conventional production well by utilizing an annular configuration so that production tubing can extend through the unit while it is installed downhole. With such a design, fluids can be produced from a well containing the unit without removing any equipment from the wellbore.

Instead of having the production tubing extending through the unit, a gas generator of the type disclosed in U.S. Pat. Nos. 3,982,591 or 4,050,515 may be used for heating the hydrocarbon formation and then removed from the borehole to allow a separate production-tubing system to be inserted into the borehole for production purposes.

Ignition of the combustible mixture formed in the downhole combustion unit may be accomplished by any means including the injection of a pyrophoric fluid with the fuel gas to initiate combustion upon contact with the oxidant, as described in U.S. Pat. No. 5,163,511, or the use of an electrical spark-generating device with electrical leads extending from the surface to the downhole combustion unit.

The very high viscosities exhibited by heavy hydrocarbons limit their mobility in the subsurface formation and make it difficult to bring the injectants and the in situ hydrocarbons into intimate contact so that they may create the desired products. Solutions to this problem may take several forms: (1) horizontally fractured wells, (2) vertically fractured wells, multiple horizontal boreholes extended from vertical wells, (4) a zone of high water saturation in contact with the zone containing the heavy hydrocarbon, (5) a zone of high gas saturation in contact with the zone containing the heavy hydrocarbon, or (6) a pathway between wells created by an essentially horizontal hole, such as established by Anderson, U.S. Pat. Nos. 4,037,658 and 3,994,340.

These configurations may be used in several ways. Horizontal fractures may be used in a continuous mode of injection and production which requires multiple wells—at least one injector (preferably vertical) and at least one producer (preferably vertical)—or in a cyclic mode with at least one well (preferably vertical). Vertical fractures may be used either in a continuous mode with at least one injector (preferably vertical) and at least one producer (preferably horizontal) or a cyclic mode with at least one injector (preferably vertical). Horizontal boreholes extended from vertical wells may be used in a continuous mode of injection and production, which requires multiple wells, or in a cyclic mode with at least one well.

When a zone of high water saturation is present in contact with the zone containing a heavy hydrocarbon, its presence is normally due to geological processes. Therefore, not all formations containing heavy hydrocarbons are in contact with a zone of high water saturation. Doscher, U.S. Pat. No. 3,279,538, showed how to inject steam into such a water-saturated zone to establish communication between multiple wells in heavy oil reservoirs. In such a case, and also in the case of horizontal fractures used in the continuous mode, it is important to inject the hot fluid rapidly enough to establish a heated zone which completely extends between at least two wells. Failure to establish a heated zone can allow displaced, heated, heavy oil to migrate into the flow path (i.e., the fracture or the water zone), lose heat, thereby become more viscous, and halt the recovery process. The injection into a water-saturated zone can be used either in the continuous or cyclic mode.

A zone of high gas saturation in contact with the zone containing a heavy hydrocarbon also provides a conduit for flow between wells. Sceptre Resources Ltd. successfully used steam injection into a gas cap in the Tangleflags Field in Saskatchewan to recover the heavy oil underlying a gas zone. A similar procedure would be possible with the in situ hydrovisbreaking process that is the subject of the present invention. In this case, the location of the gas zone above the heavy hydrocarbon might lessen the efficiency of the mixing of reactants, several of which are in the gas phase, but its high level of communication might more than offset this problem. Injection into a gas zone will probably only be efficient in the continuous mode of operation.

Anderson, U.S. Pat. Nos. 4,037,658 and 3,994,340, patented processes for establishing communication between two wells by drilling an essentially horizontal hole connecting the wells that is separated from the surrounding formation by casing. One of the wells serves as a point of injection, while the other serves as a point of production. At the beginning of the recovery process, steam is injected into the injection well and flows into the horizontal casing, which is not perforated except at the end near the producing well. The passage of steam through the horizontal pipe heats the surrounding formation by conduction to the point where the viscosity of the heavy hydrocarbon in the formation drops low enough to permit it to flow under typical injection pressures. Then, hot reaction gases are injected into the formation at the bottom of the injection well. Since the heavy hydrocarbon is now mobile, the injectants are able to displace heavy hydrocarbon into the producing well through the heated annulus that surrounds the hot, horizontal pipe. In time the heated zone grows larger, sustaining itself from the hot injected fluids and the exothermic reactions that have been initiated, and no longer requires heat from inside the horizontal pipe.

A significant disclosure of this invention is that use of fractures within the subsurface formation or the other related methods just discussed are consistent with controlling the injection of fluids into the reaction zone. As illustrated in a following example, creating fractures in a reservoir can significantly enhance the rate of fluid injection and the degree of fluid mobility within a heavy-hydrocarbon formation resulting in greatly increased recovery of converted hydrocarbons.

The steps necessary to provide the conditions required for the in situ hydrovisbreaking reactions to occur may be implemented in a continuous mode, a cyclic mode, or a combination of these modes. The process may include the use of conventional vertical boreholes, horizontal boreholes, or vertical boreholes with multiple horizontal extentions. Any method known to those skilled in the art of reservoir engineering and hydrocarbon production may be utilized to effect the desired process within the required operating parameters.

In the continuous operating mode, a number of boreholes are utilized for injection of steam and hot reducing gases. The injected gases flow through the subsurface formation, contact and react with the in situ hydrocarbons, and are recovered along with the upgraded hydrocarbons in a series of production boreholes. The injection and production boreholes may be arranged in any pattern amenable to the efficient recovery of the upgraded hydrocarbons. The rate of withdrawal of fluids from the production boreholes may be adjusted to control the pressure and the distribution of gases within the subsurface formation.

In the cyclic operating mode, multiple boreholes are operated independently in a cyclic fashion consisting of a series of injection and production periods. In the initial injection period, steam and hot reducing gases are injected into the region adjacent to the wellbore. After a period of soaking to allow conversion reactions to occur, the pressure on the wellbore is reduced and upgraded hydrocarbons are recovered during a production period. In subsequent cycles, this pattern of injection and production is repeated with an increasing extension into the subsurface formation.

A hybrid operating mode is also disclosed in which the subsurface formation is first treated using a series of boreholes employing the cyclic mode just described. After this mode is used to the limit of practical operation, a portion of the injection boreholes are converted to production boreholes and the process is operated in a continuous mode to recover additional hydrocarbons bypassed during the cyclic operation.

After completion of any of the procedures outlined above for recovery of upgraded hydrocarbons, it may be beneficial to utilize surfactants (surface active agents such as soap) which have been found to enhance oil recovery from steam-injection processes. These will also aid in oil recovery for the process of this invention. High-temperature surfactants (surfactants which retain their function at high temperatures) may be injected during the period of the operation in which the temperature of the injected fluids is less than the limit at which they are effective. Similarly, low-temperature surfactants—which include sodium hydroxide, potassium hydroxide, potassium carbonate, potassium orthosilicate, and other similar high-pH, inorganic compounds—may be injected. These surfactants react with the naturally occurring carboxylic acids in the in situ hydrocarbons to form natural surfactants, which will have beneficial effects on recovery of heavy hydrocarbons. These surfactants will be injected in a late stage of the process during the implementation of a clean-up, or scavenging phase. This phase will take advantage of the injection of cold or warm water to transport heat from areas depleted in heavy hydrocarbons to other undepleted areas, and the injected surfactants will aid in scavenging the remaining hydrocarbons.

Operation of the in situ hydrovisbreaking process will be controlled utilizing available physical measurements. Controllable elements include the injection pressure, injection rate, temperature, and fluid compositions of the injected gases. In addition, the back-pressure maintained on production boreholes may be selected to control the distribution of production rates among various boreholes. Measurements may be taken at the injection boreholes, production boreholes, and observation wells within the production patterns. All of this information can be gathered and processed, either manually or by computer, to obtain the optimum degree of conversion, product quality, and recovery level of the hydrocarbon liquids being collected.

Referring to the drawing labeled FIG. 1, there is illustrated a borehole 21 for an injection well drilled from the surface of the earth 199 into a hydrocarbon-bearing formation or reservoir 27. The injection-well borehole 21 is lined with steel casing 29 and has a wellhead control system 31 atop the well to regulate the flow of reducing gas, oxidizing fluid, and steam to a downhole combustion unit 206. The casing 29 contains perforations 200 to provide fluid communication between the inside of the borehole 21 and the reservoir 27.

Also in FIG. 1, there is illustrated a borehole 201 for a production well drilled from the surface of the earth 199 into the reservoir 27 in the vicinity of the injection-well borehole 21. The production-well borehole 201 is lined with steel casing 202. The casing 201 contains perforations 203 to provide fluid communication between the inside of the borehole 201 and the reservoir 27. Fluid communication within the reservoir 27 between the injection-well borehole 21 and the production-well borehole 201 is enhanced by hydraulically fracturing the reservoir in such a manner as to introduce a horizontal fracture 204 between the two boreholes.

Of interest is to inject hot gases into the reservoir 27 by way of the injection-well borehole 21 and continuously recover hydrocarbon products from the production-well borehole 201. Referring again to FIG. 1, three fluids under pressure are coupled to the wellhead control system 31: a source of reducing gas by line 81, a source of oxidizing-fluid by line 91, and a source of cooling-fluid by line 101. Through injection tubing strings 205, the three fluids are coupled to the downhole combustion unit 206. The fuel is oxidized by the oxidizing fluid in the combustion unit 206, which is cooled by the cooling fluid. The products of oxidation and the cooling fluid 209 along with any un-oxidized fuel 210, all of which are heated by the exothermic oxidizing reaction, are injected into the horizontal fracture 204 in the reservoir 27 through the perforations 200 in the casing 29. Heavy hydrocarbons 207 in the reservoir 27 are heated by the hot injected fluids which, in the presence of hydrogen, initiate hydrovisbreaking reactions. These reactions upgrade the quality of the hydrocarbons by converting their higher molecular-weight components into lower molecular-weight components which have less density, lower viscosity, and greater mobility within the reservoir than the unconverted hydrocarbons. The hydrocarbons subjected to the hydrovisbreaking reactions and additional virgin hydrocarbons flow into the perforations 203 of the casing 202 of the production-well borehole 201, propelled by the pressure of the injected fluids. The hydrocarbons and injected fluids arriving at the production-well borehole 201 are removed from the borehole using conventional oil-field technology and flow through production tubing strings 208 into the surface facilities. Any number of injection wells and production wells may be operated simultaneously while situated so as to allow the injected fluids to flow efficiently from the injection wells through the reservoir to the production wells contacting a significant portion of the heavy hydrocarbons in situ.

In the preferred embodiment, the cooling fluid is steam, the reducing gas is hydrogen, and the oxidizing fluid used is oxygen, whereby the product of oxidization in the downhole combustion unit 206 is superheated steam. This unit incorporates a combustion chamber in which the hydrogen and oxygen mix and react. Preferably, a stoichiometric mixture of hydrogen and oxygen is initially fed to the unit during its operation. This mixture has an adiabatic flame temperature of approximately 5,700° F. and must be cooled by the coolant steam in order to protect the combustion unit's materials of construction. After cooling the downhole combustion unit, the coolant steam is mixed with the combustion products, resulting in superheated steam being injected into the reservoir. Generating steam at the surface and injecting it to cool the downhole combustion unit reduces the amount of hydrogen and oxygen, and thereby the cost, required to produce a given amount of heat in the form of superheated steam. The coolant steam may include liquid water as the result of injection at the surface or condensation within the injection tubing. The ratio of the mass flow of steam passing through the injection tubing 205 to the mass flow of oxidized gases leaving the combustion unit 206 affects the temperature at which the superheated steam is injected into the reservoir 27. As the reservoir becomes heated to the level necessary for the occurrence of hydrovisbreaking reactions, it is preferable that a stoichiometric excess of hydrogen be fed to the downhole combustion unit during its operation—or that hydrogen be injected into the fluid stream controlling the temperature of the combustion unit—resulting in hot hydrogen being injected into the reservoir along with superheated steam. This provides a continued heating of the reservoir in the presence of hydrogen, which are the conditions necessary to sustain the hydrovisbreaking reactions.

In another embodiment, a reducing-gas mixture—comprised principally of hydrogen with lesser amounts of carbon monoxide, carbon dioxide, and hydrocarbon gases—may be substituted for hydrogen. Such a mixture has the benefit of requiring less purification yet still provides a means of sustaining the hydrovisbreaking reactions.

FIG. 1 therefore shows a hydrocarbon-production system that continuously converts, upgrades, and recovers heavy hydrocarbons from a subsurface formation traversed by one or more injection boreholes and one or more production boreholes with inter-well communication established between the injection and production boreholes. The system is free from any combustion operations within the subsurface formation and free from the injection of any oxidizing materials or catalysts.

Figure 2:
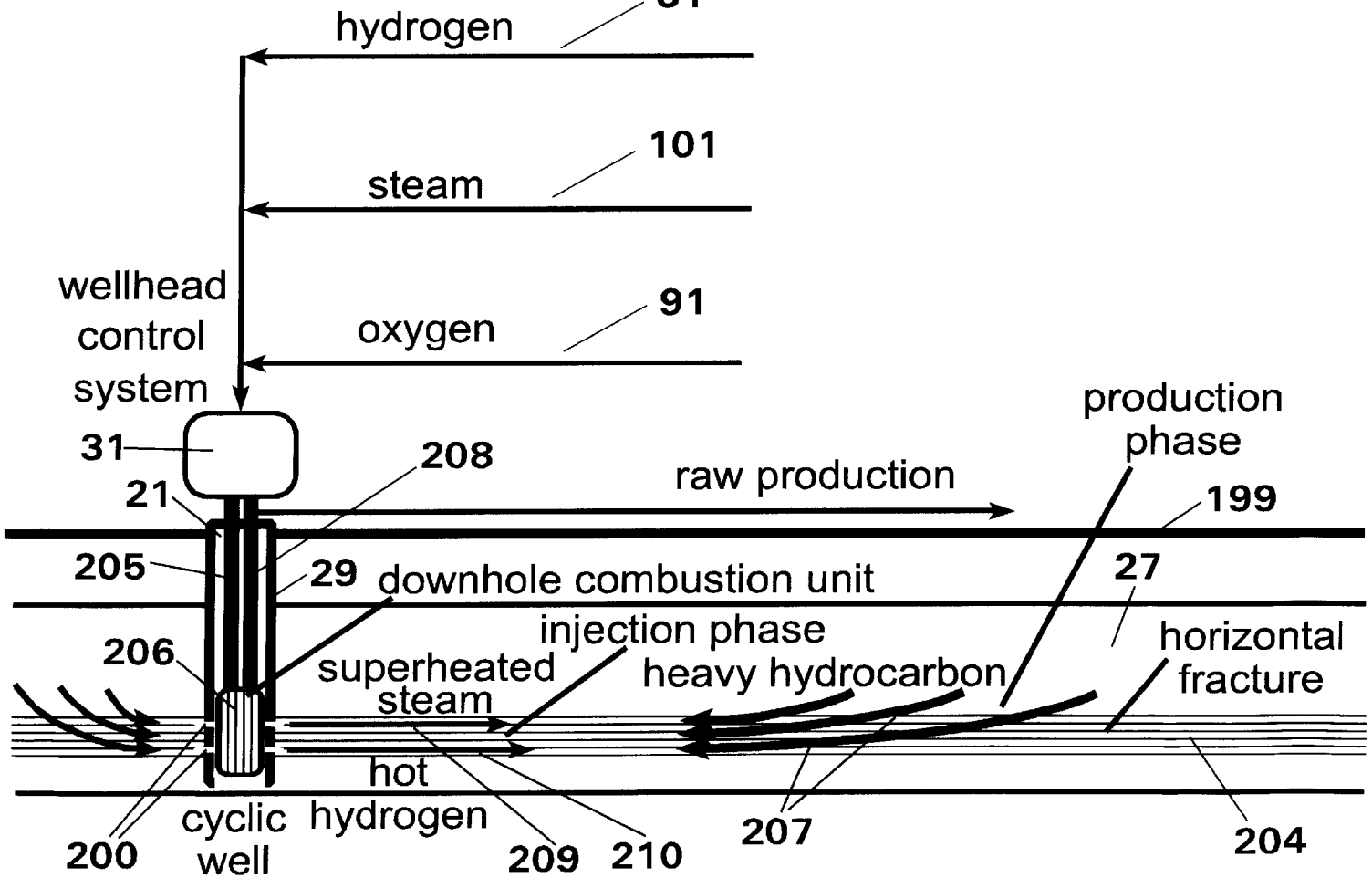
FIG. 2 is a modification of FIG. 1 in which a cyclic operating mode is illustrated whereby both the injection and production operations occur in the same borehole, with the recovery process operated as an injection period followed by a production period. The cycle is then repeated.

Referring to the drawing labeled FIG. 2, there is illustrated a borehole 21 for a well drilled from the surface of the earth 199 into a hydrocarbon-bearing formation or reservoir 27. The borehole 21 is lined with steel casing 29 and has a wellhead control system 31 atop the well. The casing 29 contains perforations 200 to provide fluid communication between the inside of the borehole 21 and the reservoir 27. The ability of the reservoir to accept injected fluids is enhanced by hydraulically fracturing the reservoir to create a horizontal fracture 204 in the vicinity of the borehole 21.

Of interest is to cyclically inject hot gases into the reservoir 27 by way of the borehole 21 and subsequently to recover hydrocarbon products from the same borehole. Referring again to FIG. 2, three fluids under pressure are coupled to the wellhead control system 31: a source of reducing gas by line 81, a source of oxidizing-fluid by line 91, and a source of cooling-fluid by line 101. Through injection tubing strings 205, the three fluids are coupled to a downhole combustion unit 206. The combustion unit is of an annular configuration so tubing strings can be run through the unit when it is in place downhole. During the injection phase of the process, the fuel is oxidized by the oxidizing fluid in the combustion unit 206, which is cooled by the cooling fluid in order to protect the combustion unit's materials of construction. The products of oxidation and the cooling fluid 209 along with any un-oxidized fuel 210, all of which are heated by the exothermic oxidizing reaction, are injected into the horizontal fracture 204 in the reservoir 27 through the perforations 200 in the casing 29. As in the continuous-production process, heavy hydrocarbons 207 in the reservoir 27 are heated by the hot injected fluids which, in the presence of hydrogen, initiate hydrovisbreaking reactions. These reactions upgrade the quality of the hydrocarbons by converting their higher molecular-weight components into lower molecular-weight components which have less density, lower viscosity, and greater mobility within the reservoir than the unconverted hydrocarbons. At the conclusion of the injection phase of the process, the injection of fluids is suspended. After a suitable amount of time has elapsed, the production phase begins with the pressure at the wellhead 31 reduced so that the pressure in the reservoir 27 in the vicinity of the borehole 21 is higher than the pressure at the wellhead. The hydrocarbons subjected to the hydrovisbreaking reactions, additional virgin hydrocarbons, and the injected fluids flow into the perforations 200 of the casing 29 of the borehole 21, propelled by the excess reservoir pressure in the vicinity of the borehole. The hydrocarbons and injected fluids arriving at the borehole 21 are removed from the borehole using conventional oil-field technology and flow through production tubing strings 208 into the surface facilities. Any number of wells may be operated simultaneously in a cyclic fashion while situated so as to allow the injected fluids to flow efficiently through the reservoir to contact a significant portion of the heavy hydrocarbons in situ.

As with the continuous-production process illustrated in FIG. 1, in the preferred embodiment the cooling fluid is steam, the fuel used is hydrogen, and the oxidizing fluid used is oxygen. Preferably, a stoichiometric mixture of hydrogen and oxygen is initially fed to the downhole combustion unit 206 so that the sole product of combustion is superheated steam. As the reservoir becomes heated to the level necessary for the occurrence of hydrovisbreaking reactions, it is preferable that a stoichiometric excess of hydrogen be fed to the downhole combustion unit during its operation—or that hydrogen be injected into the fluid stream controlling the temperature of the combustion unit—resulting in hot hydrogen being injected into the reservoir along with superheated steam. This provides a continued heating of the reservoir in the presence of hydrogen, which is the condition necessary to sustain the hydrovisbreaking reactions.

As with the continuous-production process, in another embodiment of the cyclic process a reducing-gas mixture—comprised principally of hydrogen with lesser amounts of carbon monoxide, carbon dioxide, and hydrocarbon gases—may be substituted for hydrogen.

FIG. 2 therefore shows a hydrocarbon-production system that cyclically converts, upgrades, and recovers heavy hydrocarbons from a subsurface formation traversed by one or more boreholes which have been fractured to enhance injectivity and mobility of fluids within the formation. The system is free from any combustion operations within the subsurface formation and free from the injection of any oxidizing materials or catalysts.

Figure 3A:
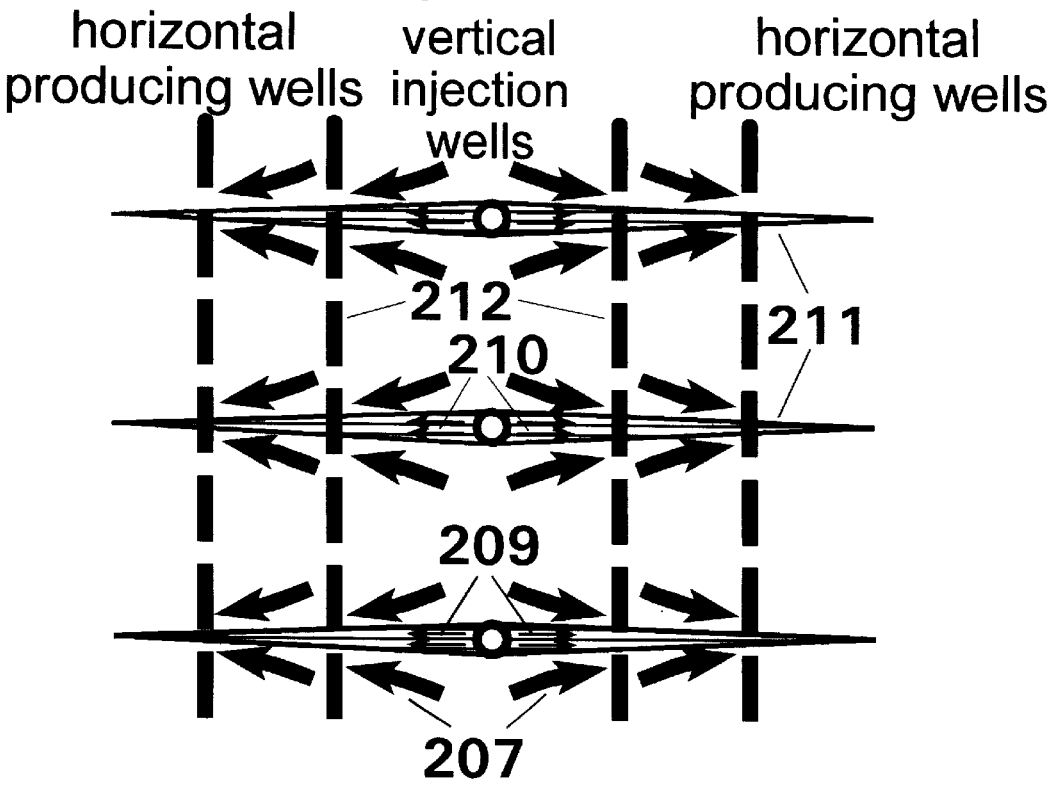
FIG. 3A is a plan view and FIG. 3B is a profile view of another embodiment featuring the use of horizontal boreholes. Injection of hot gases and steam is carried out in vertical boreholes in which vertical fractures have been created. The vertical fractures are penetrated by one or more horizontal production boreholes to efficiently collect the upgraded heavy hydrocarbons.
Figure 3B:
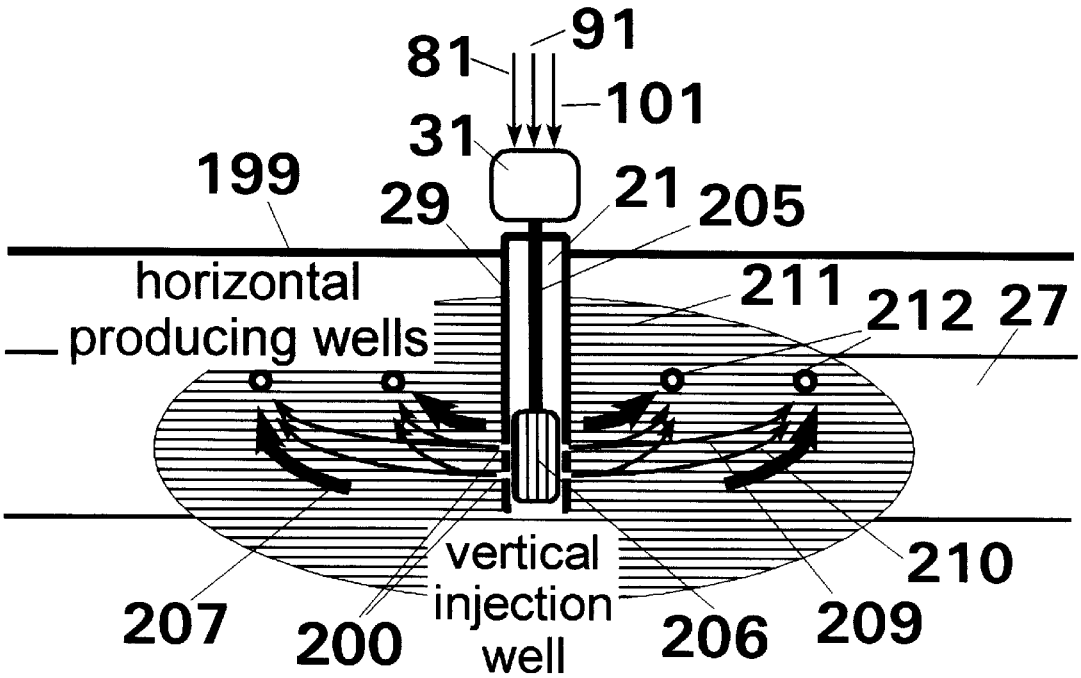

In yet embodiment, horizontal well technology is applied to the process of this invention. This method is illustrated in FIG. 3, in which FIG. 3A shows a plan view and FIG. 3B which shows a profile view, of one configuration for combining vertical injection wells with horizontal production wells. There is illustrated in FIG. 3B a borehole 21 for an injection well drilled from the surface of the earth 199 into a hydrocarbon-bearing formation or reservoir 27. The borehole is lined with steel casing 29 and has a wellhead control system 31 atop the well. The casing 29 contains perforations 200 to provide communication between the inside of the borehole 21 and the reservoir 27. The injection well borehole 27 is hydraulically fractured to create a vertical fracture 211. In the plan view of FIG. 3, there are illustrated horizontal production wells 212 with casing that is slotted to communicate with the reservoir 27. The horizontal wells are drilled so as to intersect the vertical fractures 211 of the injection wells.

It is of interest to inject hot gases into the reservoir 27 by way of one or more injection-well boreholes and continuously recover hydrocarbon products from one or more horizontal production wells. The wellhead control system 31 used to regulate the flow of injected fluids on each of the injection wells is supplied with a fuel source by line 81, an oxidizing fluid by line 91, and a cooling fluid by line 101. Through injection tubing strings 205, the three fluids are coupled to a downhole combustion unit 206. The fuel is oxidized in the combustion unit 206, which is cooled by the cooling fluid in order to protect the combustion unit's materials of construction. The products of oxidation and the cooling fluid 209 along with an un-oxidized fuel 210, all of which are heated by the exothermic oxidizing reaction, are injected into the reservoir 27 through the perforations 200 in the casing 29. Heavy hydrocarbons 207 in the reservoir 27 are heated by the hot injected fluids which, in the presence of hydrogen, initiate hydrovisbreaking reactions. These reactions upgrade the quality of the hydrocarbons by converting their higher molecular-weight components into lower molecular-weight components which have less density, lower viscosity, and greater mobility within the reservoir than the unconverted hydrocarbons. The hydrocarbons subjected to the hydrovisbreaking reactions and additional virgin hydrocarbons, propelled by the pressure of the injected fluids, flow into the vertical fractures 211 of the reservoir 27 and thence into the horizontal producing wells intersecting the fractures, where they are recovered along with the injected fluids using conventional oil-field technology.

FIG. 3 therefore shows a hydrocarbon-recovery system that continuously converts, upgrades, and recovers heavy hydrocarbons from a subsurface formation traversed by one or more vertical wells—used for injection—and by one or more horizontal wells—used for production—which are drilled within the reservoir containing the hydrocarbons. The injection wells may be vertically fractured and the horizontal wells drilled so as to intersect the fractures.

Figure 4:
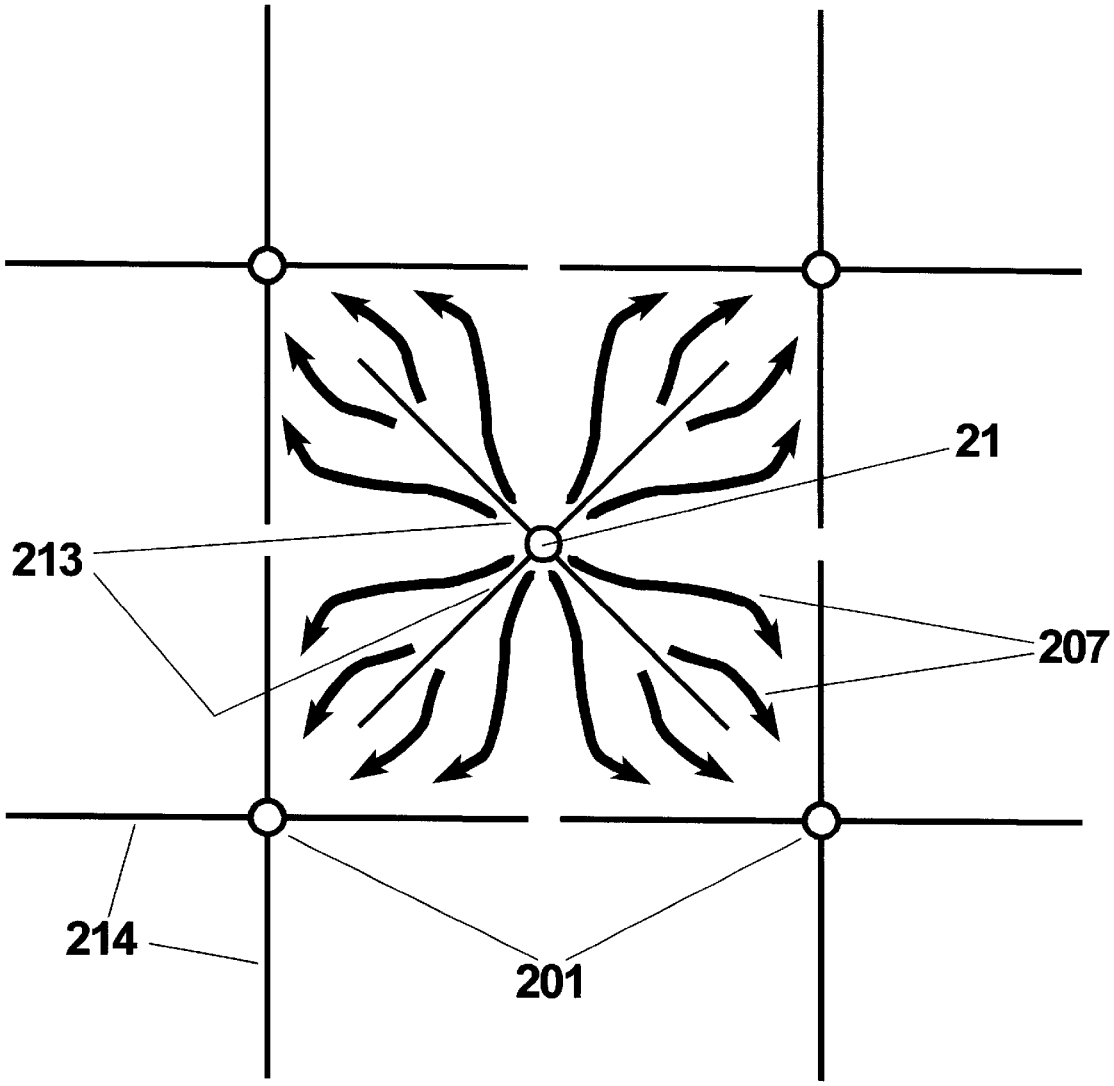
FIG. 4 is a subterranean view of another embodiment featuring multiple, uncased, horizontal boreholes extended from vertical injection and production wells. Injection of hot gases and steam is carried out in the injection wells and upgraded heavy hydrocarbons are collected in the production wells, with communication between injection and production wells enhanced by the horizontal boreholes.

In another embodiment, multiple horizontal boreholes—extended from one or more vertical injection wells and from one or more vertical production wells—are employed in a continuous-production process. This method is illustrated in FIG. 4, in which uncased, horizontal boreholes 213 are extended within a reservoir from one or more vertical injection wells 21 that are equipped as in FIG. 1, and uncased, horizontal boreholes 214 are extended within the same reservoir from vertical production wells 201 that are also equipped as in FIG. 1. Fluid communication within the reservoir between the injection wells 21 and the production wells 201 is enhanced by the boreholes extended from the wells.

As in the continuous-production process described previously, it is of interest to inject hot gases into the reservoir by way of one or more injection wells and continuously recover hydrocarbon products from one or more production wells. Previously-described hot gases are injected into the reservoir through the horizontal boreholes of one or more injection wells. Heavy hydrocarbons 207 in the reservoir are heated by the hot injected fluids which, in the presence of hydrogen, initiate hydrovisbreaking reactions. These reactions upgrade the quality of the hydrocarbons by converting their higher molecular-weight components into lower molecular-weight components which have less density, lower viscosity, and greater mobility within the reservoir than the unconverted hydrocarbons. The hydrocarbons subjected to the hydrovisbreaking reactions and additional virgin hydrocarbons, propelled by the pressure of the injected fluids, flow into the horizontal boreholes of one or more producing wells, where they are recovered along with the injected fluids using conventional oil-field technology.

FIG. 4 therefore shows the subterranean portion of a hydrocarbon-recovery system that continuously converts, upgrades, and recovers heavy hydrocarbons from a subsurface formation traversed by one or more vertical injection wells having multiple, uncased, horizontal-borehole extensions and by one or more vertical production wells having multiple, uncased, horizontal-borehole extensions which are drilled within the reservoir containing the hydrocarbons.

In yet another embodiment, multiple, horizontal boreholes—extended from one or more vertical wells—are employed in a cyclic-production process. The process is identical to the cyclic-production process previously described except that the ability of the hydrocarbon reservoir to accept injected fluids is enhanced by extending multiple, uncased, horizontal boreholes from the vertical wells into the reservoir instead of initiating in the vertical wells horizontal fractures that extend into the reservoir.

EXAMPLE I

Hydrovisbreaking Upgrades Many Heavy Crudes and Bitumens

Example I illustrates the upgrading of a wide range of heavy hydrocarbons that can be achieved through hydrovisbreaking, as confirmed by bench-scale tests. Hydrovisbreaking tests were conducted by World Energy Systems on four heavy crude oils and five natural bitumens [Reference 8]. Each sample tested was charged to a pressure vessel and allowed to soak in a hydrogen atmosphere at a constant pressure and temperature. In all cases, pressure was maintained below the parting pressure of the reservoir from which the hydrocarbon sample was obtained. Temperature and hydrogen soak times were varied to obtain satisfactory results, but no attempt was made to optimize process conditions for the individual samples.

Table 2 lists the process conditions of the tests and the physical properties of the heavy hydrocarbons before and after the application of hydrovisbreaking. As shown in Table 2, hydrovisbreaking caused exceptional reductions in viscosity and significant reductions in molecular weight (as indicated by API gravity) in all samples tested. Calculated atomic carbon/hydrogen (C/H) ratios were also reduced in all cases.

In most cases the results shown in Table 2 are from single runs, except for the San Miguel results which are the averages of seven runs. From the multiple San Miguel runs, data uncertainties expressed as standard deviation of a single result were found to be 21 cp for viscosity, 3.3 API degrees for gravity, 0.5 wt % for sulfur content, and 0.43 for C/H ratio. Comparing these levels of uncertainty with the magnitude of the values measured, it is clear that the improvements in product quality from hydrovisbreaking listed in Table 2 are statistically significant even though the conditions under which these experiments were conducted are at the lower end of the range of conditions specified for this invention, especially with regards to temperature and reaction residence time.

TABLE 2

Conditions and Results from Hydrovisbreaking Tests on Heavy Hydrocarbons (Example I)

| Crude/Bitumen | Kern River | Unknown | San Miguel | Slocum | Asphalt Ridge | Tar Sands Triangle | Athabasca | Cold Lake | Primrose |
|---|---|---|---|---|---|---|---|---|---|
| Location | California | California | Texas | Texas | Utah | Utah | Alberta | Alberta | Alberta |
| Test Conditions | | | | | | | | | |
| Temperature, ° F. | 650 | 625 | 650 | 700 | 650 | 650 | 650 | 650 | 600 |
| $H_2$ Pressure, psi | 1,000 | 2,000 | 1,000 | 1,000 | 900 | 1,000 | 1,000 | 1,500 | 1,000 |
| Soak Time, days | 10 | 14 | 11 | 7 | 8 | 10 | 3 | 2 | 9 |
| Properties Before and After Hydrovisbreaking Tests | | | | | | | | | |
| Viscosity, cp @ 100° F. | | | | | | | | | |
| Before | 3,695 | 81,900 | >1,000,000 | 1,379 | 1,070 | 700,000 | 100,000 | 10,700 | 11,472 |
| After | 31 | 1,000 | 55 | 6 | 89 | 77 | 233 | 233 | 220 |
| Ratio | 112 | 82 | 18,000 | 246 | 289 | 9090 | 429 | 486 | 52 |
| Gravity, °API | | | | | | | | | |
| Before | 13 | 7 | 0 | 16.3 | 12.8 | 8.7 | 6.8 | 9.9 | 10.6 |
| After | 18.6 | 12.5 | 10.7 | 23.7 | 15.4 | 15.3 | 17.9 | 19.7 | 14.8 |
| Increase | 6.0 | 5.5 | 10.7 | 7.4 | 2.6 | 6.6 | 11.1 | 9.8 | 3.8 |
| Sulfur, wt % | | | | | | | | | |
| Before | 1.2 | 1.5 | 7.9 | 0.3 | 0.4 | 3.8 | 3.9 | 4.7 | 3.6 |
| After | 0.9 | 1.3 | 4.8 | 0.2 | 0.4 | 2.5 | 2.8 | 2.2 | 3.8 |
| % Reduction | 29 | 13 | 38 | 33 | 0 | 35 | 29 | 53 | 0 |
| Carbon/Hydrogen Ratio, wt/wt | | | | | | | | | |
| Before | 7.5 | 7.8 | 9.8 | 8.3 | 7.2 | 8.1 | 7.9 | 7.6 | 8.8 |
| After | 7.4 | 7.8 | 8.5 | 7.6 | 70 | 8.0 | 7.6 | N/A | 7.3 |

EXAMPLE II

Hydrovisbreaking Increases Yield of Upgraded Hydrocarbons Compared to Conventional Thermal Cracking Example II illustrates the advantage of hydrovisbreaking over conventional thermal cracking. During the thermal cracking of heavy hydrocarbons coke formation is suppressed and the yield of light hydrocarbons is increased in the presence of hydrogen, as is the case in the hydrovisbreaking process.

The National Institute of Petroleum and Energy Research conducted bench-scale experiments on the thermal cracking of heavy hydrocarbons [Reference 7]. One test on heavy crude oil from the Cat Canyon reservoir incorporated approximately the reservoir conditions and process conditions of in situ hydrovisbreaking. A second test was conducted under nearly identical conditions except that nitrogen was substituted for hydrogen.

Test conditions and results are summarized in Table 3. The hydrogen partial pressure at the beginning of the experiment was 1,064 psi. As hydrogen was consumed without replenishment, the average hydrogen partial pressure during the experiment is not known with total accuracy but would have been less than the initial partial pressure. The experiment's residence time of 72 hours is at the low end of the range for in situ hydrovisbreaking, which might be applied for residence times more than 100 times longer.

TABLE 3

Thermal Cracking of a Heavy Crude Oil in the Presence and Absence of Hydrogen (Example II)

| Gas Atmosphere | Hydrogen | Nitrogen |
|---|---|---|
| Pressure cylinder charge, grams | | |
| Sand | 500 | 500 |
| Water | 24 | 24 |
| Heavy crude oil | 501 | 500 |
| Process conditions | | |
| Residence time, hours | 72 | 72 |
| Temperature, ° F. | 650 | 650 |
| Total pressure, psi | 2,003 | 1,990 |
| Gas partial pressure, psi | 1,064 | 1,092 |
| Products, grams | | |
| Light (thermally cracked) oil | 306 | 208 |
| Heavy oil | 148 | 152 |
| Residual carbon (coke) | 8 | 30 |
| Gas (by difference) | 39 | 110 |

Although operating conditions were not as severe in terms of residence time as are desired for in situ hydrovisbreaking, the yield of light oil processed in the hydrogen atmosphere was almost 50% greater than the light oil yield in the nitrogen atmosphere, illustrating the benefit of hydrovisbreaking (i.e., non-catalytic thermal cracking in the presence of significant hydrogen partial pressure) in generating light hydrocarbons from heavy hydrocarbons.

EXAMPLE III

Commercial-Scale Application of In Situ Hydrovisbreaking

Example III indicates the viability of in situ hydrovisbreaking when applied on a commercial scale. The continuous recovery of commercial quantities of San Miguel bitumen is considered.

Bench-scale experiments and computer simulations of the application of in situ hydrovis-breaking to San Miguel bitumen suggest recoveries of about 80% can be realized. The bench-scale experiments referenced in Example II include tests on San Miguel bitumen where an overall liquid hydrocarbon recovery of 79% was achieved, of which 77% was thermally cracked oil. Computer modeling of in situ hydrovisbreaking of San Miguel bitumen (described in Example IV following) predict recoveries after one year's operation of 88 to 90% within inverted 5-spot production patterns of 5 and 7.2 acres [Reference 3].

At a recovery level of 80%, at least 235,000 barrels (Bbl) of hydrocarbon can be produced from a 7.2-acre production pattern in the San Miguel bitumen formation. Assuming the produced hydrocarbon serves as the source of hydrogen, oxygen, and steam for the process, energy and material balances indicate that 103,500 Bbl of the produced hydrocarbon would be consumed in the production of process injectants. (The balances are based on the fractionation of the produced hydrocarbon into a synthetic crude oil and a residuum stream. The residuum is used as feed to a partial oxidation unit, which produces hydrogen for the process as well as fuel gas for a steam plant and for generation of the electricity used in an oxygen plant.) Thus, each production pattern would provide 131,500 Bbl of net production in one year, or about 45% of the hydrocarbon originally in place, at an average production rate of 360 barrels per day (Bbl/d).

These calculations provide a basis for the design of a commercial level of operation in which fifty 7.2-acre production patterns, each with the equivalent of one injection well and one production well, are operated simultaneously. Together, the 50 patterns would provide gross production averaging 32,000 Bbl/d, which—after surface processing—would generate synthetic crude oil with a gravity of approximately 25° API at the rate of 18,000 Bbl/d. As the projected life of each production pattern is one year, all injection wells and all production wells in the patterns would be replaced annually.

Field tests [References 2,6] and computer simulations [Reference 3] indicate a similar sized operation using steamflooding instead of in situ hydrovisbreaking would produce 20,000 Bbl/d of gross production, some three-quarters of which would be consumed at the surface in steam generation, providing net production of 5,000 Bbl/d of a liquid hydrocarbon having an API gravity of about 10°.

Figure 5:
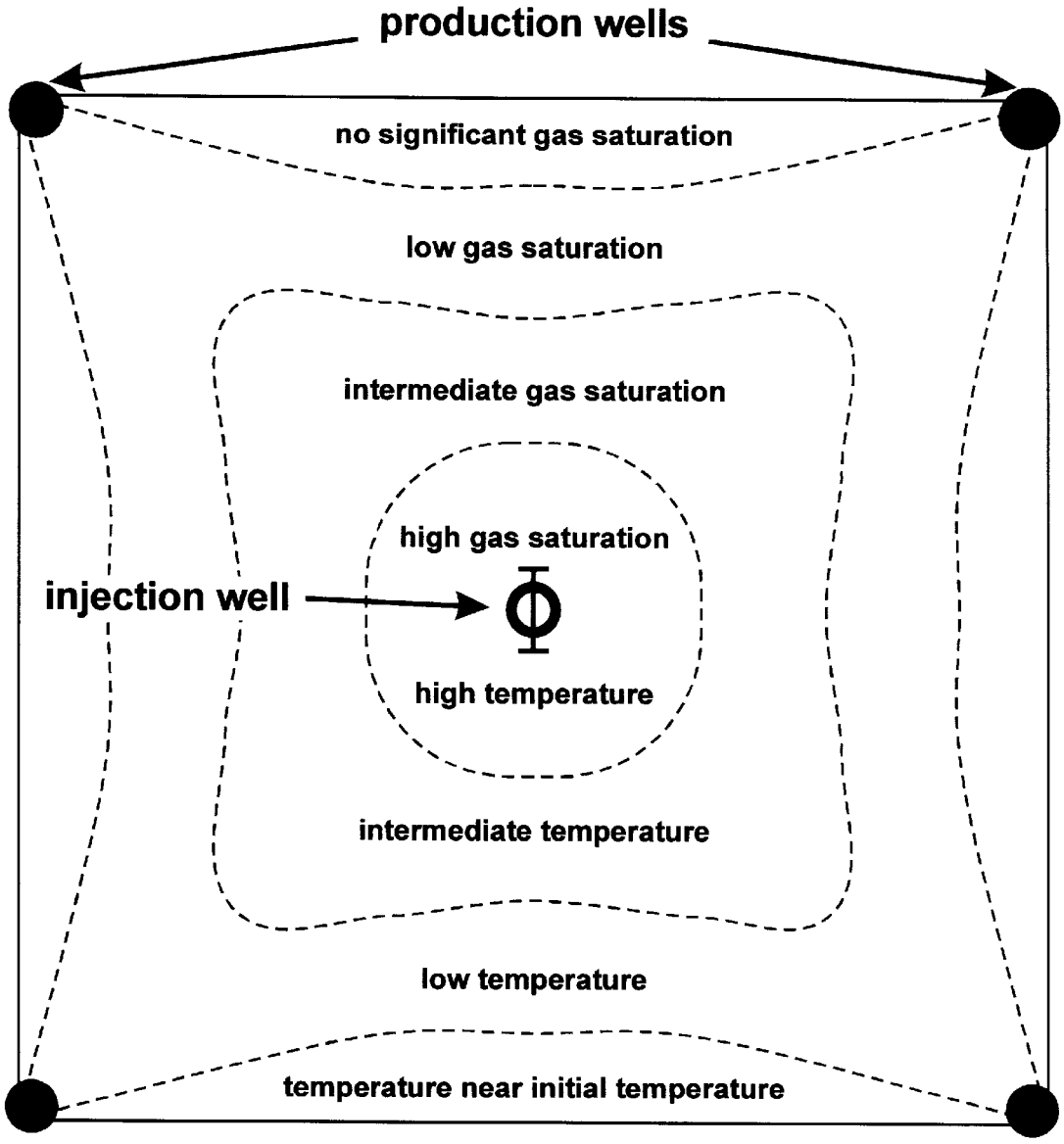
FIG. 5 is a plan view of a square production pattern showing an injection well at the center of the pattern and production wells at each of the corners. Contour lines within the pattern show the general distribution of injectants and temperature at a time midway through the production period.

FIG. 5 shows the general distribution across a nominal 5 to 7-acre production pattern of the injectants and of the temperature within the formation at a time midway through the production period. The contours within the production pattern in FIG. 5 are based on the results of computer simulations of in situ hydrovisbreaking of the San Miguel bitumen discussed below in Examples IV and V.

EXAMPLE IV

In Situ Hydrovisbreaking Promoted by Formation Fracturing

Example IV illustrates how formation fracturing makes possible the injection of superheated steam and a reducing gas into a formation containing a very viscous hydrocarbon, thereby promoting in situ hydrovisbreaking of the hydrocarbon. In situ hydrovisbreaking, conducted in the absence of fracturing, is compared through computer simulation to in situ hydrovisbreaking conducted with horizontal fractures introduced prior to injecting any fluids.

A comprehensive, three-dimensional reservoir simulation model was used to conduct the simulations discussed in this and the following examples. The model solves simultaneously a set of convective mass transfer, convective and conductive heat transfer, and chemical-reaction equations applied to a set of grid blocks representing the reservoir. In the course of a simulation, the model rigorously maintains an accounting of the mass and energy entering and leaving each grid block. Any number of components may be included in the model, as well as any number of chemical reactions between the components. Each chemical reaction is described by its stoichiometry and reaction rates; equilibria are described by appropriate equilibrium thermodynamic data.

Reservoir properties of the San Miguel bitumen formation, obtained from Reference 6, were used in the model. Chemical reaction data in the model were based on the bench-scale hydrovisbreaking experiments with San Miguel bitumen presented in Example I and on experience with conversion processes in commercial refineries. Two viscosity-temperature relationships from FIG. 7 were considered in the computer simulations without fracturing: that of Midway Sunset heavy crude oil and that of San Miguel bitumen. Only the viscosity-temperature of relationship of San Miguel bitumen was considered in the simulation incorporating fracturing.

Simulation results are summarized in Table 4. The computer simulations show that without horizontal fracturing, in situ hydrovisbreaking could only be applied with difficulty to either a heavy crude oil having the viscosity characteristics of Midway Sunset crude or to San Miguel bitumen because the lack of fluid mobility within the formation caused a very rapid build-up of pressure when injection of steam and hydrogen was attempted. In general, the cycles of injection and production could be sustained for only a few minutes, resulting in insignificant to modest hydrocarbon production.

The final column of Table 4 lists results from the computer simulation of continuous in situ hydrovisbreaking in which the physical properties of a part of the formation were altered to simulate horizontal fracturing throughout the production unit. In this case, significant quantities of upgraded hydrocarbon are recovered, indicating that in situ hydrovisbreaking can be successfully conducted in a formation which has been fractured to enhance the mobility of a very viscous hydrocarbon. Recoveries greater by orders of magnitude can be anticipated for a fractured versus unfractured operation.

TABLE 4

Simulation of In Situ Hydrovisbreaking in the Absence and Presence of Formation Fracturing (Example IV)

| Operating Mode | No Fracturing (Cyclic) | | With Fracturing (Continuous) |
|---|---|---|---|
| Type of Hydrocarbon | Heavy Crude | Bitumen | Bitumen |
| Dynamic Viscosity @ 500° F., cp[1] | 2 | 10 | 10 |
| Days of Operation | 70 | 35 | 79 |
| Steam Injected, barrels (CWE)[2] | 2,625 | 151 | 592,000 |
| Hydrogen Injected, Mcf[3] | 3,329 | 185 | 782,000 |
| Cumulative Production, barrels | 4,940 | 14 | 175,000 |
| Hydrocarbon Recovered, | 9.3 | 0.03 | 65.8 |

TABLE 4-continued

Simulation of In Situ Hydrovisbreaking in the Absence and Presence of Formation Fracturing (Example IV)

| Operating Mode | No Fracturing (Cyclic) | | With Fracturing (Continuous) |
|---|---|---|---|
| Type of Hydrocarbon | Heavy Crude | Bitumen | Bitumen |
| % OOIP[4] | | | |
| Gravity Increase, API degrees | 1.2 | 5.8 | 10.0 |

Figure 7:
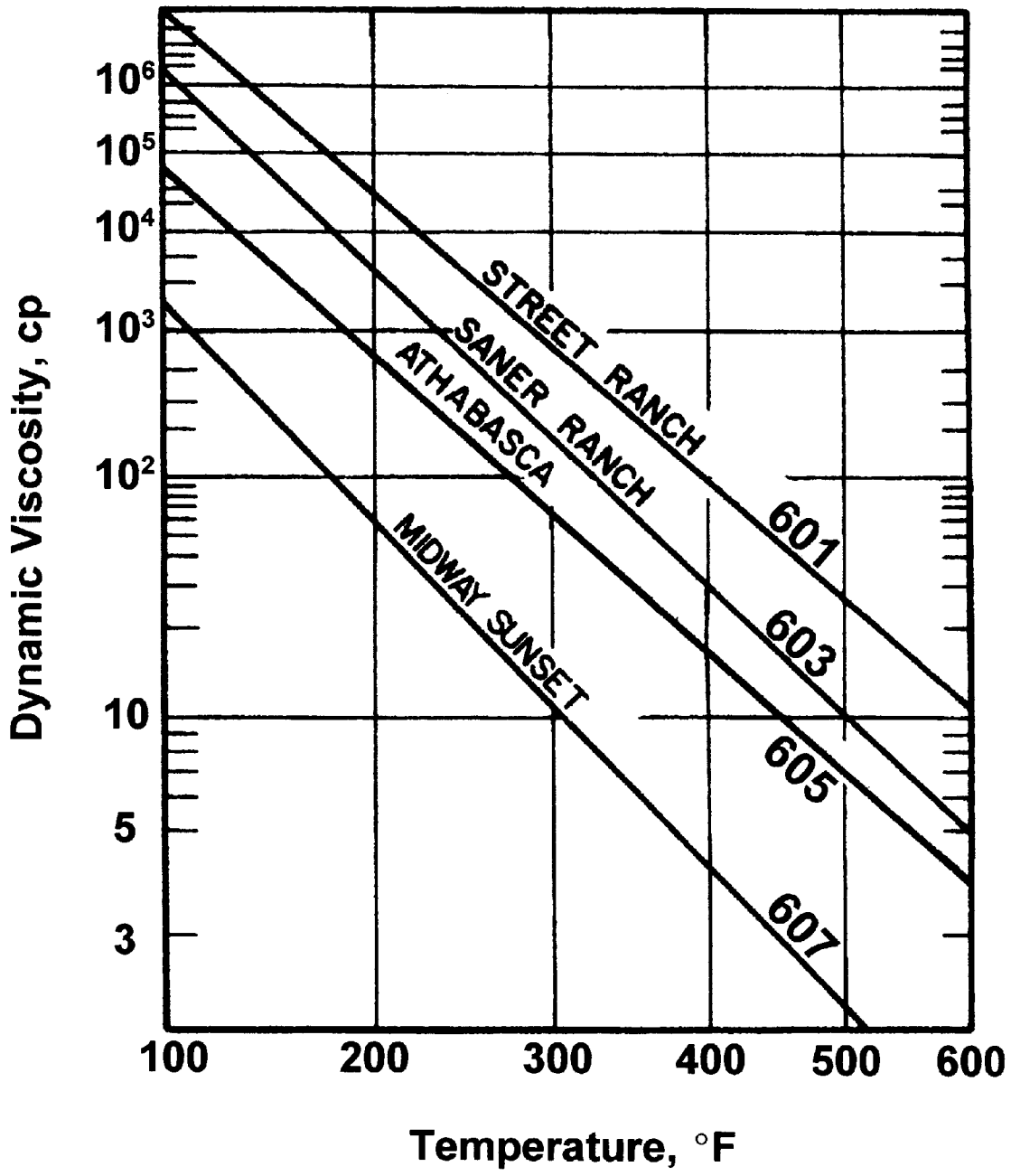
FIG. 7 is a graph in which the viscosities of four heavy hydrocarbons are plotted as a function of temperature.

[1]From FIG. 7
[2]Cold water equivalents
[3]Thousands of standard cubic feet
[4]Original oil in place

EXAMPLE V

Advantages of In Situ Hydrovisbreaking Compared to Steam Drive

Example V teaches the advantages of the upgrading and increased recovery which occur when a heavy hydrocarbon is produced by in situ hydrovisbreaking rather than by steam drive. The example also demonstrates the feasibility of applying in situ hydrovisbreaking to recover a very heavy hydrocarbon.

Figure 6:
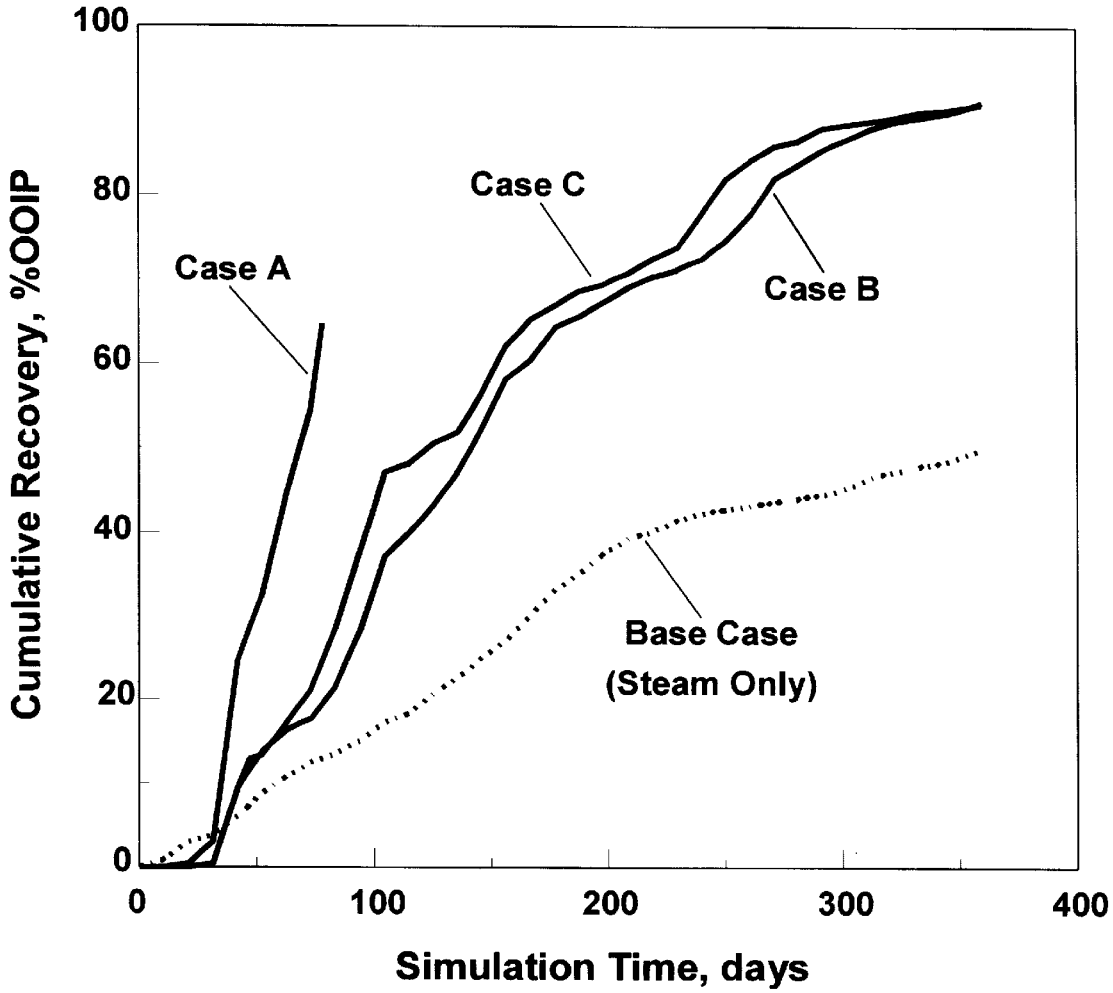
FIG. 6 is a graph showing the recovery of oil in three cases A, B, and C using the process of the invention compared with a Base Case in which only steam was injected into the reservoir. The production patterns of the Base Case and of Cases A and B encompass 5 acres. The production pattern of Case C encompasses 7.2 acres.

Through computer simulation, San Miguel bitumen was produced by steam drive (FIG. 6, "Base Case") and by in situ hydrovisbreaking (FIG. 6, "Case B") under identical conditions. The yield of hydrocarbons was more than 1.8 times greater from in situ hydrovisbreaking. Moreover, the API gravity of the hydrocarbons produced by in situ hydrovisbreaking was increased by more than 15° while there was no significant improvement in the gravity of the hydrocarbons produced by steam drive.

TABLE 5

ISHRE Process Compared to Steam Drive (Example V)

| Operating Mode | Continuous Steam Drive | Continuous In Situ Hydrovisbreaking |
|---|---|---|
| Days of Operation | 360 | 360 |
| Injection Temperature, ° F. | | |
| Steam | 600 | 600 |
| Hydrogen | — | 1,000 |
| Cumulative Injection | | |
| Steam, barrels (CWE) | 1,440,000 | 982,000 |
| Hydrogen, Mcf | 0 | 1,980,000 |
| Cumulative Production | | |
| Hydrocarbon, barrels | 129,000 | 239,000 |
| Hydrogen, Mcf | 0 | 1,639,000 |
| Total Recovery | | |
| Hydrocarbon, % OOIP | 48.6 | 89.9 |
| Hydrogen, % injected | — | 82.8 |
| In Situ Upgrading, ΔAPI degrees | 0 | 15.3 |

We claim:

1. A process for continuously converting, upgrading, and recovering heavy hydrocarbons from a subsurface formation, said process being free of in situ combustion operations (i.e., free from the injection of hot oxidizing fluids into said subsurface formation for the purpose of igniting a portion of said heavy hydrocarbons) and being free of injection of catalysts into the subsurface formation, and said process comprising the steps of:

a. inserting a downhole combustion unit into at least one vertical injection borehole which communicates with at least one production borehole by means of multiple, uncased, horizontal boreholes extending from the injection and production boreholes, said downhole combustion unit being placed at a position within said injection borehole in proximity to said subsurface formation;

b. flowing from the surface to said downhole combustion unit within said injection borehole a set of fluids—comprised of steam, reducing gases, and oxidizing gases—and burning at least a portion of said reducing gases with said oxidizing gases in said downhole combustion unit;

c. injecting a gas mixture—comprised of combustion products from the burning of said reducing gases with said oxidizing gases, residual reducing gases, and steam—from said downhole combustion unit into said subsurface formation;

d. recovering from said production borehole, production fluids comprised of said heavy hydrocarbons, which may be converted to lighter hydrocarbons, as well as residual reducing gases, and other components;

e. continuing steps b, c, and d until the recovery rate of said heavy hydrocarbons within said subsurface formation in the region between said injection borehole and said production borehole is reduced below a level of practical operation.

2. A process for cyclically converting, upgrading, and recovering heavy hydrocarbons from a subsurface formation, said process being free of in situ combustion operations (i.e., free from the injection of hot oxidizing fluids into said subsurface formation for the purpose of igniting a portion of said heavy hydrocarbons) and being free of injection of catalysts into the subsurface formation, and said process comprising the steps of:

a. inserting a downhole combustion unit into at least one vertical injection borehole in which multiple, uncased, horizontal boreholes extend from the vertical borehole, said downhole combustion unit being placed at a position within said injection borehole in proximity to said subsurface formation;

b. for a first period, flowing from the surface to said downhole combustion unit within said injection borehole a set of fluids—comprised of steam, reducing gases, and oxidizing gases—and burning at least a portion of said reducing gases with said oxidizing gases in said downhole combustion unit;

c. injecting a gas mixture—comprised of combustion products from the burning of said reducing gases with said oxidizing gases, residual reducing gases, and steam—from said downhole combustion unit into said subsurface formation;

d. for a second period, upon achieving a preferred temperature within said subsurface formation, halting injection of fluids into the subsurface formation while maintaining pressure on said injection borehole to allow time for a portion of said heavy hydrocarbons in the subsurface formation to be converted into lighter hydrocarbons;

e. for a third period, reducing the pressure on said injection borehole, in effect converting the injection borehole into a production borehole, and recovering at the surface production fluids, comprised of said heavy hydrocarbons, which may be converted to lighter hydrocarbons, as well as residual reducing gases, and other components;

f. repeating steps b through e to expand the volume of said subsurface formation processed for the recovery of said heavy hydrocarbons until the recovery rate of said heavy hydrocarbons within said subsurface formation in the vicinity of said injection borehole is below a level of practical operation.

* * * * *